US005752809A

United States Patent [19]

Makino et al.

[11] Patent Number: 5,752,809

[45] Date of Patent: May 19, 1998

[54] VARIABLE DISPLACEMENT COMPRESSOR

[75] Inventors: Yoshihiro Makino; Kenji Takenaka, both of Kariya, Japan

[73] Assignee: Kabushiki Kaisha Toyoda Jidoshokki Seisakusho, Kariya, Japan

[21] Appl. No.: 704,364

[22] Filed: Aug. 28, 1996

[30] Foreign Application Priority Data

Sep. 4, 1995 [JP] Japan ..... 7-226796

[51] Int. Cl.[6] ..... F04B 1/12

[52] U.S. Cl. ..... 417/269; 184/6.17

[58] Field of Search ..... 417/269, 222.2, 417/222.1; 91/499; 184/6.17

[56] References Cited

U.S. PATENT DOCUMENTS

| | | | |
|---|---|---|---|
| 4,664,604 | 5/1987 | Terauchi | 417/222.2 |
| 5,364,232 | 11/1994 | Kimura et al. | 417/269 |

FOREIGN PATENT DOCUMENTS

| | | | |
|---|---|---|---|
| 0334634 | 9/1989 | European Pat. Off. | 417/222.2 |
| 0536989 A1 | 4/1993 | European Pat. Off. | 417/269 |
| 4342299 A1 | 1/1995 | Germany | 417/269 |
| 4-5479 | 1/1992 | Japan | 417/222.2 |
| 4-8876 | 1/1992 | Japan | 417/222.2 |

*Primary Examiner*—Timothy Thorpe
*Assistant Examiner*—Peter G. Korytwyk
*Attorney, Agent, or Firm*—Brooks Haidt Haffner & Delahunty

[57] ABSTRACT

A cam plate is mounted on a drive shaft in a crank chamber. A plurality of pistons are operably coupled to the cam plate. The rotation of the drive shaft is converted to a linear reciprocal movement to compress and discharge refrigerant gas containing oil mist. An extracting passage extracts the refrigerant gas from the crank chamber to remove an excessive pressure in the crank chamber. The extracting passage is open to an accommodating chamber which receives the refrigerant gas from the passage. A bearing is disposed in the accommodating chamber and receives an axial load acting on the drive shaft. A bolt absorbs an assembly tolerance of the bearing. A first protuberance is provided on the bearing protruding in a radial direction with respect to the drive shaft so as to become aligned with the passage. The first protuberance engages an inner surface of the accommodating chamber to prevent rotation of the bearing.

20 Claims, 3 Drawing Sheets

VARIABLE DISPLACEMENT COMPRESSOR

BACKGROUND OF THE INVENTION

1. Field of the Invention

The present invention relates generally to a variable displacement compressor. More particularly, the present invention pertains to a variable displacement compressor that compresses refrigerant gas and is typically incorporated in a vehicle air conditioner.

2. Description of the Related Art

A variable displacement compressor has a thrust bearing at the distal end of a drive shaft. Generally, this rear thrust bearing is sometimes not sufficiently lubricated. Especially, in a single-headed piston type variable displacement compressor, the inner pressure in a crank chamber needs to be accurately adjusted to control the displacement of the compressor. A compressor of this type, therefore, has a crank chamber that is disconnected from an external refrigerant circuit. Lubricant oil is introduced into a crank chamber when it is accompanied by blowby gas from a compression chamber or refrigerant gas drawn from a discharge chamber to control the pressure in the crank chamber. When the compressor shifts from the minimum displacement operation to the maximum displacement operation, the gas in the crank chamber is led to the suction chamber and oil mist contained in the gas is discharged outside the compressor with the gas. This results in shortage of the lubricant oil in the crank chamber. The lubricant oil therefore is not provided to every corner of the crank chamber. This causes an insufficient lubrication of the thrust bearing.

Japanese Unexamined Patent Publication 3-11166 discloses a compressor for solving the above inconvenience. This compressor has a passage extending from the crank chamber to the outer periphery of the bearing. This compressor has a rear axial bearing lubricated by oil contained in the blowby gas flown from the crank chamber to the suction chamber.

It is noted that components in a compressor generally have their own tolerances different from one another. This results in different margins of error in assembling of the compressor. More specifically, the compressor has a drive shaft carrying a lug plate and a wobble plate in fixed members such as a cylinder block and a front housing. The wobble plate converts a rotation of the drive shaft to a linear reciprocal movement of pistons between the predetermined top dead center and bottom dead center. The error of assembling of the movable members and the fixed members causes the deviation of the top dead center. A bolt is therefore incorporated in a compressor with its distal end contacting the race of the rear thrust bearing. The margin difference is absorbed by the bolt, in other words, the extent to which the bolt is screwed in is altered in accordance with the error in each compressor.

In the above compressor, the passage for oil that lubricates the rear thrust bearing is directly open to the outer periphery of the bearing. When the compressor is in operation, a pair of races and rollers of the bearing rotate according to the rotation of a drive shaft. The bearing is lubricated by oil mist contained in the refrigerant gas passing through the races and rollers. Having a greater specific gravity compared to the refrigerant gas, the oil mist oil is more likely to be affected by centrifugal force. The oil is therefore often dispersed radially failing to be introduced into the bearing.

This results in the insufficient lubrication of the bearing. Passing through very narrow gaps defined between the races and rollers makes resistance applied to the refrigerant gas rather large.

The Japanese Publication 3-11166 neither discloses nor suggests any counter measure for stopping the rotation of the race that does not contact the drive shaft. Therefore, in a compressor having the margin absorbing mechanism as the above, the rotation of the drive shaft is indirectly transmitted to the bolt in the mechanism. More specifically, the bolt is rotated by the race that is not in contact with the drive shaft. This may loosen the bolt and result in a deviation of margins in the bearing and other components. The deviation causes noise and vibration when the compressor is in operation.

SUMMARY OF THE INVENTION

It is a major objective of the present invention to provide a variable displacement compressor that maintains satisfactory lubrication in the thrust bearing.

To achieve the above objective, a variable displacement compressor according to the present invention has a cam plate mounted on a drive shaft in a crank chamber and a piston operably coupled to the cam plate. A rotation of the drive shaft is converted to a linear reciprocal movement. The movement compresses and discharges refrigerant gas containing oil mist. The compressor has an extracting passage for extracting the refrigerant gas from the crank chamber to remove an excessive pressure in the crank chamber. The compressor also has an accommodating chamber. The accommodating chamber receives the refrigerant gas from the passage that is open to the accommodating chamber. A bearing is disposed in the accommodating chamber to receive an axial load acting on the drive shaft. The compressor has means for absorbing an assembling tolerance of the bearing. A first projection is provided with the bearing and protrudes in a radial direction with respect to the drive shaft so as to be aligned with the passage that is open to the accommodating chamber. The projection engages an inner surface of the chamber to prevent a rotation of the bearing.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
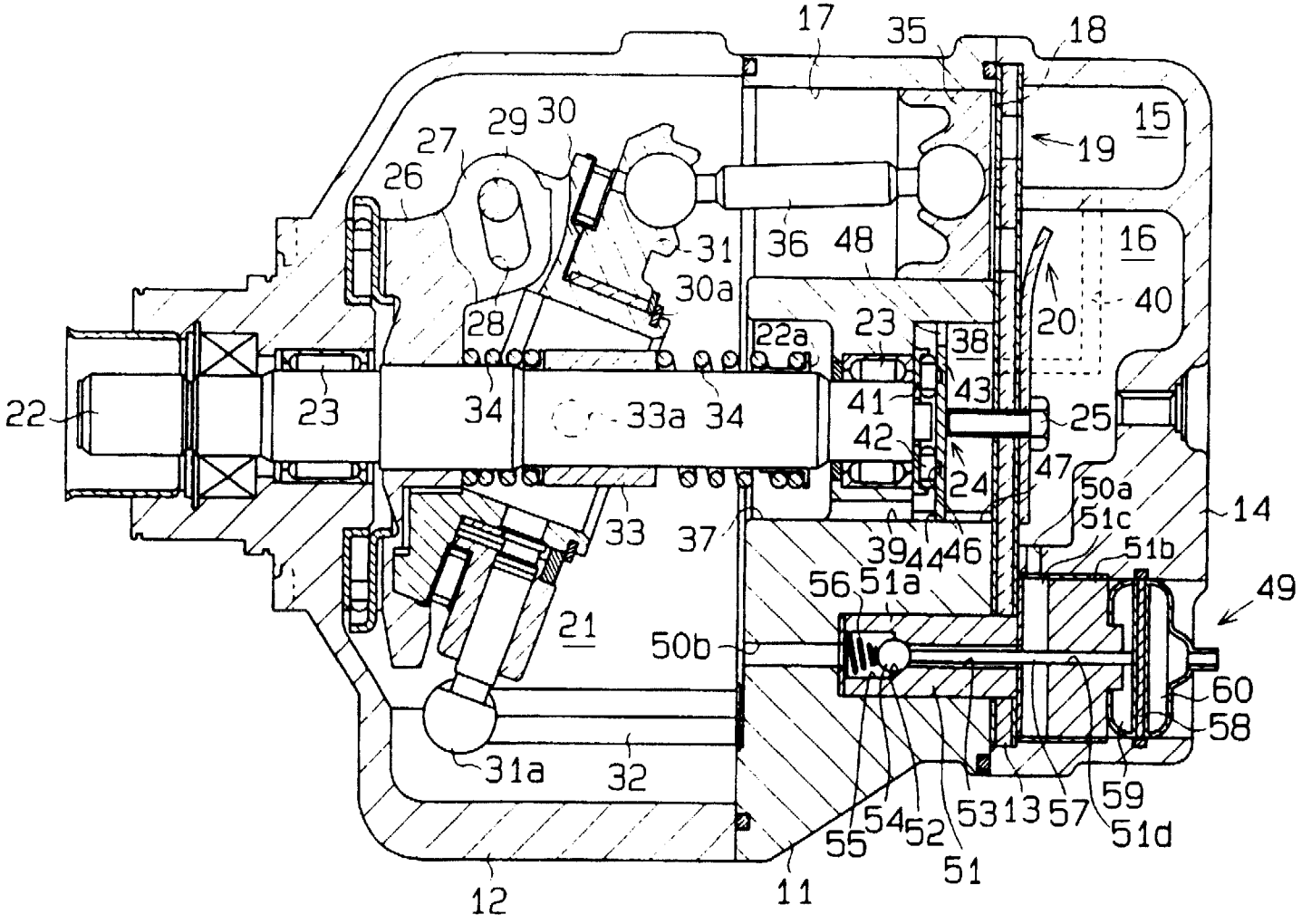
FIG. 1 is a sectional view illustrating a variable displacement compressor according to a first embodiment of the present invention.

As shown in FIG. 1, a front housing 12 is directly coupled to the front end of a cylinder block 11, while a rear housing 14 is coupled to the rear end of the block 11 with a valve plate 13 provided in-between. A suction chamber 15 and a discharge chamber 16 are defined in the rear housing 14. A plurality of cylinder bores 17 are defined in the cylinder block 11. Each cylinder bore 17 accommodates a piston 35, which reciprocates within the associated bore 17. A compression chamber 18 is defined by the valve plate 13, the cylinder bore 17 and the piston 35.

A suction mechanism 19 is provided in the valve plate 13 for drawing refrigerant gas from the suction chamber 15 into the compression chamber 18. The volume of the compression chamber 18 is altered according to the reciprocal movement of the piston 35. A discharge mechanism 20 is provided in the valve plate 13 for discharging refrigerant gas from the compression chamber 18 to the discharge chamber 16.

A crank chamber 21 is defined between the block 11 and the front housing 12. A drive shaft 22 is supported by a pair of radial bearings 23 in the center of the crank chamber 21. A margin absorbing bolt 25 for absorbing assembly tolerance of the compressor is screwed through the discharge mechanism 20 and the valve plate 13. A thrust bearing 24 is located between the distal end of the bolt 25 and the rear end of the shaft 22 so that the bolt 25 absorbs the assembly tolerance of the bearing.

A lug plate 26 is mounted on the shaft 22 for an integral rotation with the shaft 22 in the crank chamber 21 An arm 27 having an elongated hole 28 is formed at the outer peripheral section of a lug plate 26 and protrudes rearward. A cylindrically shaped slider bushing 33 is mounted on the drive shaft 22 and is reciprocally movable in a front and rear axial direction. A rotary journal 30 or cam plate is loosely mounted on the drive shaft 22. The journal 30 has a boss jointed with the slider bushing 33 by a pair of coupling pins 33*a*. The journal 30 is also jointed with the lug plate 26. Specifically, a pin 29 is secured at the outer peripheral portion of the journal 30 so as to correspond to the arm section 27, and is fitted into the elongated hole 28.

Therefore, the journal 30 is arranged to integrally rotate with the drive shaft 22 and the lug plate 26 and swings about the coupling pins 33*a*. When the journal 30 rotates about the coupling pins 33*a*, the pin 29 slides along the elongated hole 28, and the slider bushing 33 moves along the drive shaft 22. A wobble plate 31 is provided on the boss section 30*a* of the journal 30. A pin 31*a* having a spherical head is fitted to the wobble plate 31. A rod 32 is secured to the cylinder block 11 and the front housing 12, with which the pin 31*a* is engaged. The engagement of the pin 31*a* and the rod 32 prevents the rotation of the swash plate 31, while allowing the swing motion in a back-and-forth direction. A pair of springs 34 are located between the lug plate 26 and the slider bushing 33 and between a spring retainer 22*a* and the slider bushing 33, respectively. The urging force of the springs 34 maintains the slider bushing 33 at the midpoint of the lug plate 26 and the spring retainer or stopper 22*a* when the compressor is not operating. The pistons 35 are coupled to the wobble plate 31 by a piston rod 36.

A recess 37 is formed on the front end of the cylinder block 11 in its central portion. A bearing chamber 38 or an accommodating chamber is defined on the rear end of the block 11 in its central portion. An extracting passage 39 in the cylinder block 11 connects the recess 37 with the chamber 38. The bearing chamber 38 is connected to the suction chamber 15 via a passage 40. The thrust bearing 24 is provided at the front end of the bearing chamber 38.

Figure 2:
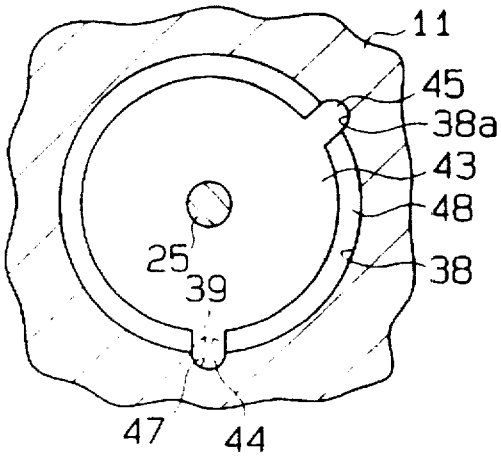
FIG. 2 is an enlarged partial sectional view illustrating an outer race viewed from the right side of FIG. 1.
Figure 3:
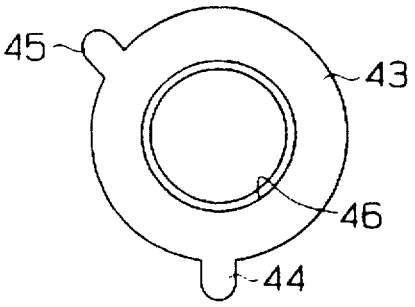
FIG. 3 is a plan view of the outer race in FIG. 1 as viewed from the left side of FIG. 1.

The bearing 24 has an inner race 41, a plurality of rollers 42 and an outer race 43. As shown in FIG. 2 and 3, the outer race 43 has a first protuberance 44 and a second protuberance 45 both projecting radially with respect to the shaft 22. The outer race 43 further has an annular groove 46 formed on the front side, i.e. the side that contacts the rollers 42. The groove 46 retains lubricant oil. As shown in FIGS. 1 and 2, the protuberance 44 engages with a recess 47 formed on the inner surface of the bearing chamber 38. The bottom of the recess 47 is formed continuously with the lower inner surface of the passage 39. The protuberance 44 is therefore aligned with the passage 39. As shown in FIG. 2, a space 48 is defined between the outer race 43 and the inner surface of the bearing chamber 38.

The second protuberance 45 engages with a second recess 38*a* formed on the inner surface of the bearing chamber 38. Fitting the protuberance 45 in the recess 38*a* helps to assemble the outer race 43 in the bearing chamber 38 in the right direction.

As shown in FIG. 1, the discharge chamber 16 communicates with the crank chamber 21 via passages 50*a* and 50*b* and a control valve 49 provided in the rear housing 14 and the cylinder block 11. The control valve 49 connects and disconnects the chambers 16 and 21. The control valve 49 includes a casing 51, which consists of a front portion 51*a* and a rear portion 51*b*. A pressure chamber 51*c* is defined between the front portion 51*a* and the rear portion 51*b*. The pressure chamber 51*c* is connected to the discharge chamber 16 via the passage 50*a*. A valve chamber 55 is formed on the front end of the portion 51*a*. A through hole 53 is formed in the front portion for connecting the valve chamber 55 and the pressure chamber 51*c*.

A valve seat 52 is formed in the valve chamber 55 at the opening of the through hole 53. The rear portion 51*b* also has a through hole 51*d*. The diameter of the hole 51*d* is slightly smaller than that of the hole 53. The holes 53 and 51*d* are formed on the same axis. A space formed at the rear end of the portion 51*b* is divided by a diaphragm 58. The front portion of the space serves as a pressure sensitive chamber 59 and is connected with suction chamber 15 via a passage (not shown). The rear portion of the space serves as a constant pressure chamber 60.

A rod 57 is slidably retained in the holes 53 and 51*d*. The diameter of the rod 57 is almost the same as that of the hole 51*d*. The rear end of the rod 57 contacts the diaphragm 58. A valve ball 54 is provided at the front end of the rod 57. A spring 56 is provided in the valve chamber 55 for urging the ball 54 toward the rear end of the compressor. With only the urging force of the spring applied thereto, the ball 54 contacts the valve seat 52, thereby disconnecting the hole 53 from the valve chamber 55. The discharge chamber 16 and the crank chamber 21 are disconnected from one another, accordingly.

The action of the compressor having the above structure will now be described.

When the shaft 22 is rotated by an external drive source, such as a vehicle engine, the lug plate 26, the pin 29 and the rotary journal 30 rotate integrally. The wobble plate 31 is swung in the back-and-forth direction without rotating with the shaft 22. This swinging motion is then transmitted to the pistons 35 via the associated piston rods 36. In this manner, the rotation of the drive shaft 22 is converted into linear reciprocal motion of the pistons 35. As a result, the pistons 35 are sequentially reciprocated in the associated cylinder bores 17. The motion of the pistons 35 first draws refrigerant gas from the suction chamber 15 into the compression chamber 18 of the cylinder bore 17. The gas is then compressed in the chamber 18 and discharged to the discharge chamber 16.

The piston 35 in a compression stroke results in blowby gas drawn into the crank chamber through the gap defined between the outer surface of the piston 35 and the inner wall of the cylinder bore 17. This blowby gas is then drawn into the bearing chamber 38 from the crank chamber 21 via the passage 39, thereafter being led to the suction chamber 15 via the passage 40. An increase in the pressure in the crank chamber by the blowby gas is thus prevented, accordingly. The amount of the blowby gas drawn into the suction chamber 15 from the crank chamber 21 depends on the diameter at the opening of the passages 39 and 40.

When the compressor is not in operation, pressure Ps in the suction chamber 15, pressure Pd in the discharge chamber and pressure Pc in the crank chamber are equal one to another. At this time, the slider bushing 33 and the wobble plate 31 are located at the midpoint of the shaft 22 by the urging force of the springs 34. The ball valve 54 in the control valve 49 contacts the valve seat 52 and closes the passage 53. Rotating the shaft 22 by an external drive force causes the pistons 35 to reciprocate in the, corresponding cylinder bores 17. The reciprocation of the pistons 35 compresses refrigerant gas and discharges the gas into the discharge chamber 16.

At the beginning of the operation, the high ambient temperature or the high cooling load applied to the compressor makes the pressure Ps in the suction chamber 15 high. This pressure difference acts on the front and rear end of each piston 35 and the reciprocation of the pistons 35 is increased. This causes an increase in the moment that increases the inclination of the wobble plate 30. The slider bushing 32 is then moved forward against the force of the spring 34. The displacement of the compressor is thus maximized.

The pressure sensitive chamber 59 being connected to the suction chamber 15 causes the pressure Ps in the suction chamber 15 to be applied to the chamber 59. The pressure Ps acts on the diaphragm 58, thereby keeps closing the passage 53 with the ball valve 54. The compression action of the piston 35 causes the gas in the compression chamber 18 to leak into the crank chamber 21, thereby increasing the pressure Pc in the crank chamber. Drawn into the suction chamber 15 via the passage 39, the bearing chamber 38 and the passage 40, the blowby gas exerts almost no influence upon the difference between the pressures Pc and Ps. The compressor therefore continues operating at the maximum displacement.

When the compressor has worked over a certain period of time, the ambient temperature drops, i.e. the cooling load applied to the compressor decreases. Accordingly, the pressure Ps in the suction chamber 15 decreases, accordingly. The pressure sensitive chamber 59 connected to the suction chamber 15 causes the internal pressure of the chamber 59 to decrease as the pressure Ps decreases. When the internal pressure in the chamber 59 becomes lower than the predetermined pressure, the diaphragm 58 acts in response to the difference of the pressures and shifts the ball valve 54 forward with the rod 58. The ball valve 54 is then moved forward against the force of the spring 56, thereby opening the passage 53.

The high pressure refrigerant gas in the discharge chamber 16 is drawn into the crank chamber 21 via the passage **50*a*, the passage 53 in the control valve 49 and the passage 50*b*. This causes the pressure Pc in the crank chamber 21 to become higher. The difference between the pressures Pc and Ps acts on the both sides of each piston 35, thereby increasing the moment acting to decrease the inclination of the wobble plate 31. The slider bushing 33 is then moved backward against the force of the rear spring 34. The inclination angle of the wobble plate 31 is thus decreased. This results in shortening the stroke of the piston 35**. The compressor operates at the smaller displacement, accordingly. The cooling capacity of the compressor decreases in accordance with the change of the cooling load.

When the compressor has worked over a certain period of time at the small displacement, its cooling load increases based on the raise of the ambient temperature. This increases the pressure Ps in the suction chamber 15 and thus the pressure in the chamber 59. When the pressure in the chamber 59 becomes higher than the predetermined pressure, the diaphragm 58 reacts with the difference of the pressures-and pulls the rod 57.

Therefore, the rod 57 withdraws from the ball valve 54. The ball valve 54 urged by the spring 56 contacts the valve seat 52 to disconnect the discharge chamber 16 with the crank chamber 21. The refrigerant gas in the crank chamber 21 is drawn into the suction chamber 15 via the passage 39, the chamber 38 and the passage 40. As a result, the pressure Pc in the crank chamber 21 drops and becomes small. The difference of the pressures Pc and Ps acts on the front and rear ends of the piston 35 such that the slider bushing is slid forward to increase the inclination angle of the wobble plate 31. The compressor therefore starts operating at the maximum displacement as it does when starting operation.

The protrusion 44 provided on the outer race 43 in the bearing 24 fitted in the recess 47 of the cylinder block 11 prevents the outer race 43 from being rotated by the shaft 22. The bolt 25 is Wherefore not loosened with rotation of the race 43. This allows the compressor to operate with little noise and vibration.

The protrusion 44 also serves to guide the refrigerant gas into the thrust bearing 24. The protrusion 44 of the thrust bearing 24 extends into the passage 39. The refrigerant gas therefore collides with the protrusion 44 and is drawn into the bearing 24 along the outer race 43. The lubricant oil misted in the gas adheres to the front face of the race 43 to form an oil film. This oil film is pushed into the thrust bearing 24 by the flow of the refrigerant gas. In conventional compressors, the misted lubricant oil in the refrigerant gas is directly drawn into the thrust bearing. Having a specific gravity greater than that of the refrigerant gas, the misted oil is thrown out of the thrust bearing by centrifugal force. The oil retained in the groove 46 ensures a stable existence of the oil film in the thrust bearing 46. In this embodiment, the misted oil is changed into the film before being introduced in the thrust bearing 24. The surface tension of the film makes the oil relatively unaffected by centrifugal force. The lubricant oil is thus sufficiently supplied to the thrust bearing 24.

Although it has a very simple design, the compressor of the present invention prevents a backlash of the thrust bearing and the discharge mechanism 20 caused by the rotation of the rotary shaft and effectively provides the thrust bearing 24 with lubricant oil.

The passage 39 extending substantially parallel to the drive shaft 11 requires a minimum necessary length and little gradient. This results in a smooth introduction of refrigerant gas into the passage 39.

The space 48 defined between the outer race 43 and the inner wall of the chamber 38 reduces the resistance of the refrigerant gas when flowing through the chamber 38. The refrigerant gas is therefore smoothly drawn into the suction chamber 15. Accordingly, when the inclination angle of the wobble plate 31 is being increased, the pressure in the crank chamber 21 smoothly drops. This allows the compressor to swiftly shift to the maximum displacement operation.

It is noted that a plurality of the passages 39 and the protrusions 44 may be formed. This further facilitates the lubrication of the thrust bearings 24.

Figure 4:
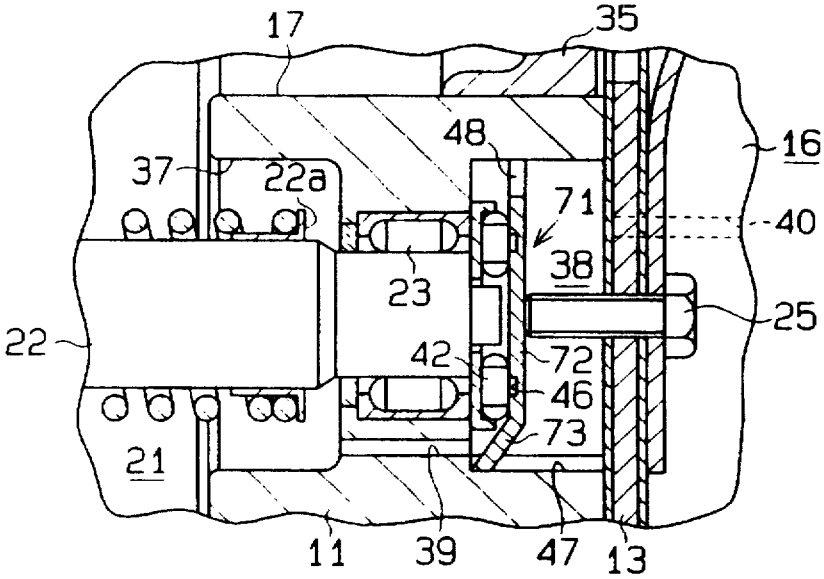
FIG. 4 is an enlarged partial sectional view illustrating a thrust bearing of a variable displacement compressor according to a second embodiment of the present invention.

A second embodiment of the present invention will now be described with reference to FIG. 4. In the second embodiment, a protrusion 73 equivalent to the protrusion 44 in the first embodiment, protrudes in a slanting direction with respect to an outer race 72 of a thrust bearing 71. This facilitates the introduction of refrigerant gas into the thrust bearing 71 along the slanting surface, resulting in that the lubrication of the thrust bearing 71 is thus facilitated.

Figure 5:
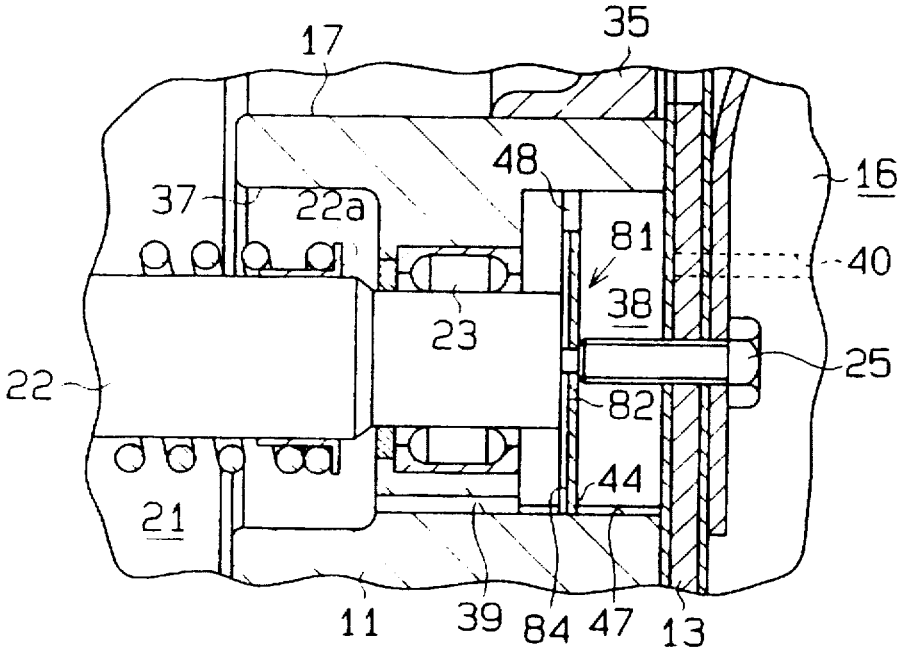
FIG. 5 is an enlarged partial sectional view illustrating a thrust bearing and its vicinity of a variable displacement compressor according to a third embodiment of the present invention.
Figure 6:
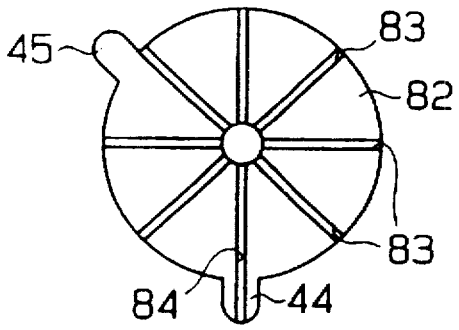
FIG. 6 is a plan view of a thrust bearing of FIG. 5.

A third embodiment of the present invention will now be described with reference to FIGS. 5 and 6.

A thrust bearing 81 supporting the rear end of the drive shaft 22 comprises a slide bearing. The slide bearing includes a washer 82. On the surface contacting the shaft 22, an oil guiding groove 84 extends from the protrusion 44 to the center of the washer 82. A plurality of oil retaining grooves 83 radially extend on the same surface.

This allows the refrigerant gas to collide with the protrusion 44 and be drawn into the space between the washer 82 and the rear end of the drive shaft 22. The misted lubricant oil in the gas adheres to the protrusion 44. The flow of the gas pushes and shifts the oil along the front surface of the washer 83. The oil is thus shifted into the bearing 81 and effectively distributed over its entire range by means of the groove 84. The distributed oil is retained in the grooves 83, thereby forming a stable oil film between the shaft end and the washer 82. The oil film and the washer 82 serve as a dynamic pressure bearing for receiving the thrust load of the drive shaft 22.

Forming the rear thrust bearing 81 with a washer 82 as described above reduces the number of parts for assembling a compressor. This reduces the manufacturing cost of a compressor.

In this embodiment, the annular groove 46 explained in the first embodiment may be formed on the shaft side of the washer 82 in addition to the grooves 83 and 84. This helps forming a more stable oil film between the end of the shaft 22 and the washer 82.

Although only a few embodiments of the present invention have been described herein, it should be apparent to those skilled in the art that the present invention may be embodied in many other specific forms without departing from the spirit or scope of the invention. Particularly, it should be understood that the members in the compressor are not limited to those shown in the embodiments. For example, the wobble plate may be replaced by a swash plate. Therefore, the present examples and embodiments are to be considered as illustrative and not restrictive and the invention is not to be limited to the details given herein, but may be modified within the scope of the appended claims.

What is claimed is:

1. A variable displacement compressor including a cam plate mounted on a drive shaft in a crank chamber and a piston operably coupled to the cam plate, wherein rotation of the drive shaft is converted to a linear reciprocal movement of the piston to compress and discharge refrigerant gas containing oil mist, said compressor comprising:

an extracting passage for extracting the refrigerant gas from the crank chamber to reduce excessive pressure in the crank chamber;

an accommodating chamber for receiving the refrigerant gas from the extracting passage which is open to the accommodating chamber;

a bearing disposed in the accommodating chamber to receive an axial load acting on the drive shaft;

said extracting passage being located at the periphery of said accommodating chamber in communication with said bearing;

means for absorbing an assembly tolerance of the bearing; and the bearing including a first protuberance that extends in a radial direction with respect to the drive shaft aligned with the extracting passage for deflecting oil out of the refrigerant gas that flows through the extracting passage, said protuberance engaging an inner surface of the accommodating chamber to prevent rotation of the bearing.

2. The compressor as set forth in claim 1, wherein said accommodating chamber includes a first recess for receiving the first protuberance.

3. The compressor as set forth in claim 2 further comprising:

a suction chamber; and a connecting passage for connecting the suction chamber with the accommodating chamber to pass the refrigerant gas to the suction chamber;

whereby said refrigerant gas will collide against the first protuberance and be introduced into the bearing whereby so that the oil mist lubricates the bearing.

4. The compressor as set forth in claim 3, wherein said bearing comprises:

an inner race close to the extracting passage;

an outer race spared axially the inner race;

a roller disposed between the inner race and the outer race; and said first protuberance being provided on an outer race.

5. The compressor as set forth in claim 4 further comprising a receiving surface provided on the outer race, said receiving surface being opposed to the inner race to receive the refrigerant gas flow, whereby oil mist will form an oil film on the receiving surface.

6. The compressor as set forth in claim 5 further comprising:

said outer race including a second protuberance; and said accommodating chamber including a second recess for receiving the second protuberance, said second recess and second protuberance being located to ensure assembling the bearing with the receiving surface facing the inner race.

7. The compressor as set forth in claim 6, wherein said receiving surface includes a groove for retaining the oil mist.

8. The compressor as set forth in claim 7, wherein said outer race is disposed in the accommodating chamber with a space therebetween to decrease the resistance that refrigerant gas flow would receive in the accommodating chamber.

9. The compressor as set forth in claim 8, wherein said first protuberance slantingly extends toward the inner race.

10. The compressor as set forth in claim 9 further comprising:

a rear housing disposed adjacent to the crank chamber; and a valve plate separating the rear housing from the crank chamber; and wherein said absorbing means includes a bolt mounted on the valve plate to urge the bearing against the drive shaft.

11. The compressor as set forth in claim 3, wherein said bearing includes a washer.

12. The compressor as set forth in claim 11, wherein said washer includes a surface that contacts the drive shaft, a groove for introducing the oil mist to the contacting surface, and a groove for retaining the oil mist.

13. The compressor as set forth in claim 8, wherein said first protuberance slantingly extends toward the inner race.

14. The compressor as set forth in claim 13, wherein said bearing includes a washer and wherein said washer includes a surface that contacts the drive shaft, a groove for introducing the oil mist to the contacting surface, and a groove for retaining the oil mist.

15. A variable displacement compressor including a cam plate mounted on a drive shaft in a crank chamber and a piston operably coupled to the cam plate, wherein rotation of the drive shaft is converted to a linear reciprocal movement of the piston to compress and discharge refrigerant gas containing oil mist, said compressor comprising:

an extracting passage for extracting the refrigerant gas from the crank chamber to reduce excessive pressure in the crank chamber;

an accommodating chamber for receiving the refrigerant gas from the extracting passage which is open to the accommodating chamber;

a bearing disposed in the accommodating chamber to receive an axial load acting on the drive shaft;

said extracting passage being located at the periphery of said accommodating chamber in communication with said bearing;

means for absorbing an assembly tolerance of the bearing;

the bearing including a first protuberance that extends in a radial direction with respect to the drive shaft aligned with the extracting passage, said protuberance engaging an inner surface of the accommodating chamber to prevent rotation of the bearing; and said accommodating chamber including a first recess for receiving the first protuberance;

whereby said refrigerant gas will collide against the first protuberance and be introduced into the bearing so that the oil mist lubricates the bearing.

16. The compressor as set forth in claim 15 further comprising:

a suction chamber; and a connecting passage for connecting the suction chamber with the accommodating chamber to pass the refrigerant gas to the suction chamber.

17. The compressor as set forth in claim 16, wherein said bearing comprises:

an inner race close to the extracting passage;

an outer race spaced axially from the inner race;

a roller disposed between the inner race and the outer race;

said first protuberance being provided on the outer race; and a receiving surface provided on the outer race, said receiving surface facing the inner race to receive the refrigerant gas flow, whereby oil mist will form an oil film on the receiving surface.

18. The compressor as set forth in claim 17 further comprising:

said outer race including a second protuberance; and said accommodating chamber including a second recess for receiving the second protuberance, said second recess and second protuberance being located to ensure assembling the bearing with the receiving surface facing the inner race.

19. The compressor as set forth in claim 18, wherein said receiving surface includes a groove for retaining the oil mist.

20. The compressor as set forth in claim 19, wherein said outer race is disposed in the accommodating chamber with a space therebetween to decrease the resistance that the refrigerant gas flow would receive in the accommodating chamber.

* * * * *

UNITED STATES PATENT AND TRADEMARK OFFICE

CERTIFICATE OF CORRECTION

PATENT NO. : 5,752,809
DATED : May 19, 1998
INVENTOR(S) : Y. Makino et al.

It is certified that error appears in the above-indentified patent and that said Letters Patent is hereby corrected as shown below:

Column 3, line 25, insert a --.-- (period) after "21".

Column 5, line 20, delete the --.-- (period) after "the" (second occurrence).

Column 6, line 15, delete the "-" (hyphen) between "pressures" and "and";

line 32, change "Wherefore" to --therefore--.

Column 8, line 27, delete first word "whereby";
line 56, delete the "," (comma) between "The" and "compressor".

Signed and Sealed this

Seventeenth Day of November, 1998

*Attest:*

*Attesting Officer*

Bruce Lehman

BRUCE LEHMAN

*Commissioner of Patents and Trademarks*